US009682012B2

(12) United States Patent
Pattison et al.

(10) Patent No.: US 9,682,012 B2
(45) Date of Patent: Jun. 20, 2017

(54) CONTAINER FOR STORAGE OF A MEDICAMENT

(71) Applicant: MYLAN, INC., Morgantown, WV (US)

(72) Inventors: Michael J. Pattison, Belvidere, IL (US); Michael Doon Armstrong, Rockton, IL (US)

(73) Assignee: Mylan, Inc., Morgantown, WV (US)

( * ) Notice: Subject to any disclaimer, the term of this patent is extended or adjusted under 35 U.S.C. 154(b) by 40 days.

(21) Appl. No.: 14/554,378

(22) Filed: Nov. 26, 2014

(65) Prior Publication Data

US 2016/0143808 A1 May 26, 2016

(51) Int. Cl.

| | |
|---|---|
| ***A61J 1/03*** | (2006.01) |
| ***B65B 61/00*** | (2006.01) |
| ***B65D 17/00*** | (2006.01) |
| ***B65D 75/36*** | (2006.01) |
| ***B65D 50/00*** | (2006.01) |

(52) U.S. Cl.

CPC ..... *A61J 1/035* (2013.01); *B65B 61/007* (2013.01); *B65D 17/163* (2013.01); *B65D 50/00* (2013.01); *B65D 75/367* (2013.01); *B65D 2575/367* (2013.01)

(58) Field of Classification Search

CPC ..... B65D 17/163; B65D 17/00; B65D 17/06; B65D 75/327; B65D 75/3236; B65B 61/007; A61J 1/035

USPC ..... 206/528, 532

See application file for complete search history.

(56) References Cited

U.S. PATENT DOCUMENTS

| | | | | |
|---|---|---|---|---|
| 4,398,634 A * | 8/1983 | McClosky | ..... | B65D 75/323 206/484 |
| 5,046,618 A * | 9/1991 | Wood | ..... | B65D 75/327 206/484 |
| 6,352,158 B1 * | 3/2002 | Cole-Bennett | ..... | B65D 75/327 206/469 |
| 6,422,391 B1 * | 7/2002 | Swartz | ..... | B65D 75/327 206/469 |
| 7,395,928 B2 | 7/2008 | Bertsch | | |
| 7,866,474 B2 | 1/2011 | Geser | | |

(Continued)

FOREIGN PATENT DOCUMENTS

EP 0778018 A1 6/1997

OTHER PUBLICATIONS

International Search Report and Written Opinion of the International Searching Authority, mailed on Jan. 21, 2016, of International Application No. PCT/US2015/062273 filed on Nov. 24, 2015.

(Continued)

*Primary Examiner* — Chun Cheung

(74) *Attorney, Agent, or Firm* — Sorell, Lenna & Schmidt, LLP; William D. Schmidt, Esq.

(57) ABSTRACT

Various embodiments are described for a container for storage of a medicament, the container comprising a surface having at least a cavity configured to store at least one dose of the medicament; and a covering disposed over at least the cavity of the surface and comprising at least two adjacent edges and a set of perforations disposed on the covering and spaced apart from the at least two adjacent edges of the covering. A container comprising a sheet of separable units and methods for use are described.

24 Claims, 6 Drawing Sheets

(56) References Cited

U.S. PATENT DOCUMENTS

| | | | | |
|---|---|---|---|---|
| 2006/0131204 | A1* | 6/2006 | Geser | B65D 75/327 206/530 |
| 2007/0012592 | A1 | 1/2007 | Bertsch et al. | |
| 2007/0289893 | A1* | 12/2007 | Williams | B65D 75/327 206/531 |
| 2013/0081968 | A1* | 4/2013 | Kurtze | B65D 75/327 206/461 |

OTHER PUBLICATIONS

Pilchik, Ron. "Pharmaceutical Blister Packaging, Part I, Rationale and Materials," Pharmaceutical Technology, Nov. 2000.
Milmount Healthcare, 2014. "What Is a Blister Pack?" from website: http://www.blisterpack.ie/, visited Nov. 26, 2014.

* cited by examiner

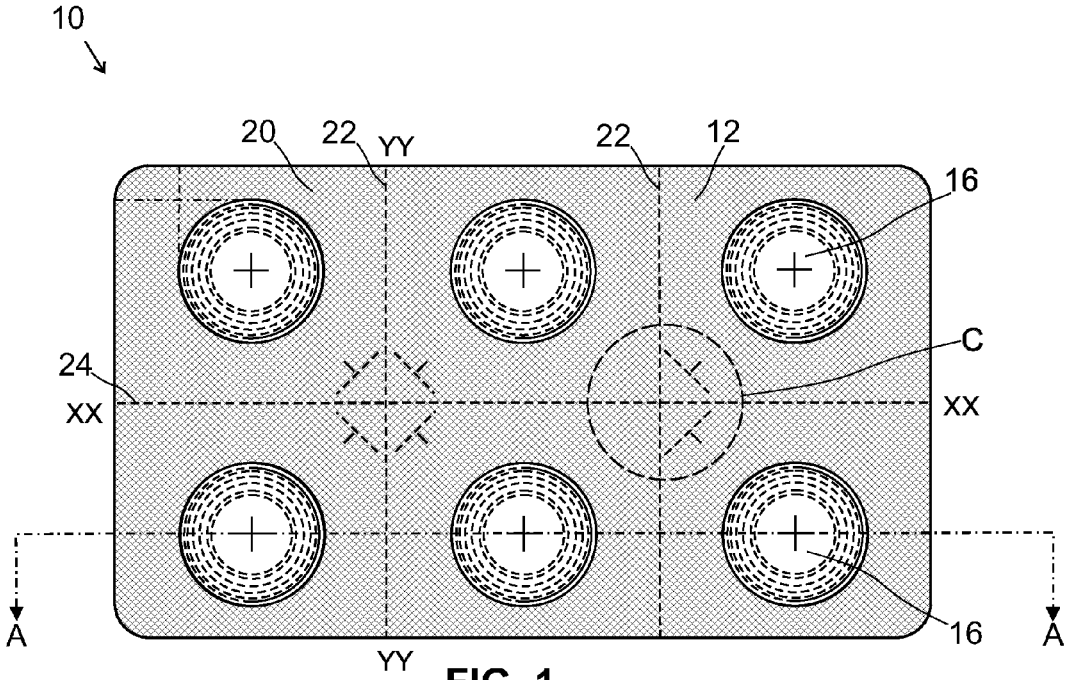
FIG. 1
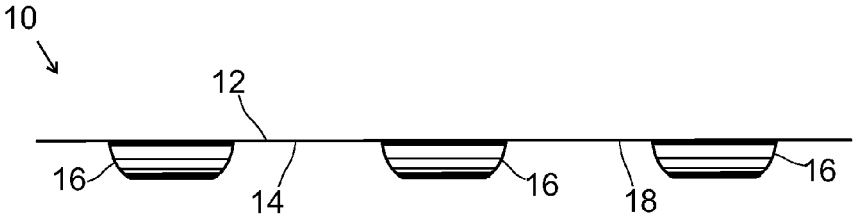
FIG. 2
FIG. 3
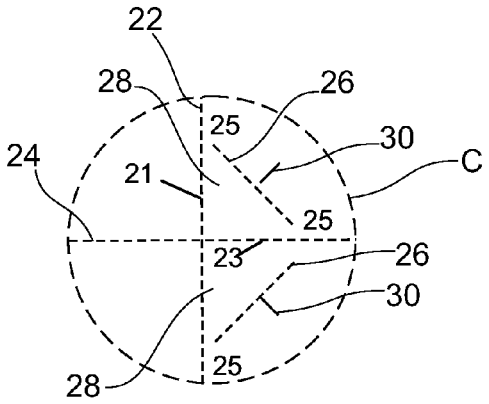

CONTAINER FOR STORAGE OF A MEDICAMENT

BACKGROUND

Containers for medicaments typically are non-reusable and store a quantity of medicament until the container is opened. One example of a non-reusable medicament container is the blister package, which is a durable and tamper proof container. Blister packages are commonly used in different industries, including the medical and consumer healthcare industries. Within these industries, blister packages may be used as containers for medicaments in various forms, such as pills, tablets, mini-tablets, capsules, or liquids.

Blister packages provide a number of benefits for the user and for storage of the medicament. Blister packages can be clearly labeled with, among other things, the medicament name, the dose, dosage form, manufacturer, lot number, expiration date and other information such as how to take the medication. Blister packages not only reduce the risk of outdated medication being taken by the user, but they also reduce the risk of medication errors as the package is clearly labeled and the user will know exactly how much medication to take.

Blister packages are also useful for protecting products against external factors, such as humidity and contamination for extended periods of time. Opaque blisters also protect light-sensitive medicaments against radiation. In some cases, blister packages provide barrier protection for shelf life requirements. Blister packages may also provide a degree of tamper resistance and protection against mechanical forces during storage and dispensing.

Blister packages are commonly used for packing physician samples of drug products, or for Over the Counter (OTC) products. Blister packages can also be used to repackage bulk drug products in unit dose-blister packages for dispensing in hospitals and physician offices.

The main advantages of unit-dose blister packages over other methods of packing pharmaceutical products are the assurance of product/packaging integrity of each individual dose and the possibility to create a compliance pack or calendar pack by printing the days of the week above each dose.

Blister packages may also provide further information for the end user. Instructions as to how to open the blister package may be printed onto a covering so that an informed adult may easily open the blister packages. Dosage and usage warnings may also be printed onto a covering of a blister packages to further inform an end user.

Although containers for medicaments including blister packages provide many benefits, there is a need for new containers for medicaments that allow the container to be torn to dispense the medicament. Features that make it difficult for children to open such containers would also be beneficial.

SUMMARY

The present application provides new containers for medicaments that allow the container to be torn to dispense the medicament. Child-resistant containers for medicaments are also provided. The containers for medicaments help to maintain product integrity for each individual dose of medicament, help with patient compliance and reduce overdoses of medicament.

In one embodiment, there is a container for storage of a medicament, the container comprising a surface (e.g., forming film, or a thermoformed film, or a thermoformed plastic sheet) having at least one cavity configured to store at least one dose of the medicament; and a covering (e.g., lid) disposed over at least the cavity of the surface and comprising at least two adjacent edges and a set of perforations disposed on the covering and spaced apart from the at least two adjacent edges of the covering.

In another embodiment, the surface further comprises at least two adjacent edges and a plurality of first perforations disposed on the surface and spaced apart from the at least two adjacent edges of the surface, the plurality of first perforations extending substantially diagonally to the at least two adjacent edges of the surface.

In yet another embodiment, there is a container for storage of a medicament, the container comprising a surface having at least two adjacent edges and a cavity configured to store at least one dose of the medicament, a first perforation disposed on the surface and spaced apart from the at least two adjacent edges of the surface, the first perforation extending substantially diagonally to the at least two adjacent edges; a covering disposed over at least the cavity of the surface and comprising at least two adjacent edges, a second perforation disposed on the covering and spaced apart from the at least two adjacent edges of the covering.

In some embodiments, there is a container for storage of a medicament, the container comprising a sheet comprising a surface and a covering, the sheet further comprising a plurality of separable units, each unit comprising a cavity formed in the surface and configured to store at least one dose of medicament and a covering disposed over at least the cavity of the surface and comprising at least two adjacent edges and a set of perforations disposed on the covering and spaced apart from the at least two adjacent edges of the covering.

The present application further provides a method for dispensing a medicament from a container for storage of a medicament, the method comprising manipulating a tab of the container, the container comprising a surface having at least a cavity configured to store at least one dose of the medicament; and a covering disposed over at least the cavity of the surface and comprising at least two adjacent edges and a set of perforations disposed on the covering and spaced apart from the at least two adjacent edges of the covering to define the tab; separating the tab from the container; and tearing the container along a tear line defined by a crease.

In some embodiments, there is a method for making a container for storage of a medicament, the method comprising placing a medicament in a cavity of a surface configured to store the medicament; sealing a covering over at least the cavity of the surface having at least two adjacent edges; and pressing a set of perforations into the surface and/or covering such that the perforations are spaced apart from the at least two adjacent edges.

In some embodiments, there is a container for storage of a medicament, which is configured to be torn to dispense the medicament or gain access to the medicament. In some embodiments, there is a crease that is configured to provide a tear line to split the container apart for dispensing the medicament.

In some embodiments, the container for storage of a medicament is configured to contain a single unit dose of a solid or liquid medicament within the cavity. In some embodiments, the container comprises at least two cavities, each cavity comprising a single medicament. In some embodiments, the container comprises at least two cavities, each cavity comprising more than one medicament.

In some embodiments, the container for storage of a medicament is child-resistant. The device is configured to provide difficulty for children to access stored medicaments, yet allow adults to easily access the medicaments.

Other features and advantages of the present disclosure will become apparent from the following detailed description. It should be understood, however, that the detailed description and the specific examples, while indicating preferred embodiments of the disclosure, are given by way of illustration only, since various changes and modifications within the spirit and scope of the disclosure will become apparent to those skilled in the art from this detailed description.

BRIEF DESCRIPTION OF THE DRAWINGS

In part, other aspects, features, benefits and advantages of the embodiments will be apparent with regard to the following description, appended claims, and accompanying drawings in which:

FIG. 1 illustrates a top phantom view of one embodiment of the container for the medicament shown as a blister package. The blister package comprises a sheet having separable units divided by perforations extending along a horizontal axis XX and a vertical axis YY, wherein each separable unit has a cavity for storage of a medicament, a tab that is removable from the separable unit, and a crease for tearing the separable unit;

FIG. 2 illustrates a side cross sectional view of a blister package sheet having separable units along cross section AA as shown in FIG. 1;

FIG. 3 illustrates enlarged section C highlighted in FIG. 1 showing corners of adjacent separable units having a tab that is removable from each of the separable units via a set of perforations;

Figure 4:
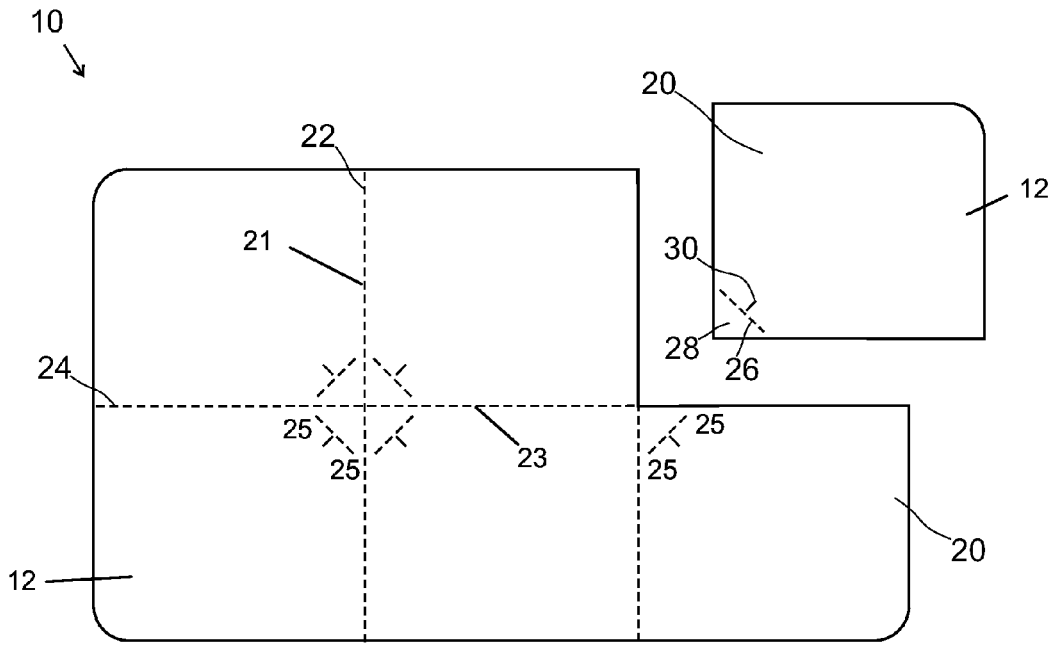
FIG. 4 illustrates a top view of a covering for a blister package sheet having separable units as shown in FIG. 1, wherein one of the separable units has been separated from the sheet.

It is to be understood that the figures are not drawn to scale. Further, the relation between objects in a figure may not be to scale, and may in fact have a reverse relationship as to size. The figures are intended to bring understanding and clarity to the structure of each object shown, and thus, some features may be exaggerated in order to illustrate a specific feature of a structure.

DETAILED DESCRIPTION

The present disclosure may be understood more readily by reference to the following detailed description of the disclosure presented in connection with the accompanying drawings, which together form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. The following description is presented to enable any person skilled in the art to make and use the present disclosure.

Notwithstanding that the numerical ranges and parameters setting forth the broad scope of the application are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "1 to 10" includes any and all subranges between (and including) the minimum value of 1 and the maximum value of 10, that is, any and all subranges having a minimum value of equal to or greater than 1 and a maximum value of equal to or less than 10, e.g., 5.5 to 10.

DEFINITIONS

As used in the specification and including the appended claims, the singular forms "a," "an," and "the" include the plural, and reference to a particular numerical value includes at least that particular value, unless the context clearly dictates otherwise.

Ranges may be expressed herein as from "about" or "approximately" one particular value and/or to "about" or "approximately" another particular value. When such a range is expressed, another embodiment includes from the one particular value and/or to the other particular value.

Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

For purposes of the description contained herein, with respect to components and movement of components described herein, "forward" or "distal" (and forms thereof) means forward, toward or in the direction of the forward or distal end of the probe portion of the device that is described herein, and "rearward" or "proximal" (and forms thereof) means rearward or away from the direction of the forward, or distal end of the probe portion of the device that is described herein. However, it should be understood that these uses of these terms are for purposes of reference and orientation with respect to the description and drawings herein, and are not intended to limit the scope of the claims.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", or the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features.

The medicament, which can be in a solid, liquid, or semi-solid dosage form is stored in the container until the time it is dispensed therefrom. The container can be, in some embodiments, a pouch, a strip, a blister pack or blister package. As used herein, the term "blister pack" or "blister package" is to be understood to refer to a package of medicament (or similar product), in which discrete quantities or units of the medicament are stored in a "blister" and dispensed by applying force (e.g., a tearing force or a pushing force) to the blister to expel or dispense the medicament from the blister pack. The present application can be utilized with currently available blister packaging technology, adapted for use with known blister pack configurations, or adapted for use with blister packs specifically designed to be incorporated into the present configuration.

As used herein, the term "medicament" is to be understood to refer to a variety of medications, both prescription and non-prescription medications, nutrients, dietary supplements, vitamins, etc. These can be in solid, liquid and/or semi-solid dosage forms (e.g., gels). As applied to the present disclosure, medicaments can be available to users or patients as over-the-counter therapy or by prescription only, and can be in the form of tablets, mini-tablets, capsules, powders, liquids, creams, granules, etc. These can be suitable for oral, topical, intranasal, rectal, vaginal, ocular, auricular, or inhalation administration. The term "medicament", as used herein, includes any substance (i.e., compound or composition of matter) which, when administered to an organism (human or animal) induces a desired pharmacologic and/or physiologic effect by local and/or systemic action. The term therefore encompasses substances traditionally regarded as actives, drugs or bioactive agents, as well as biopharmaceuticals (e.g., peptides, hormones, nucleic acids, gene constructs, etc.) typically employed to treat a number of conditions which is defined broadly to encompass diseases, disorders, infections, or the like. Exemplary medicaments include, without limitation, antibiotics, antivirals, $H_2$-receptor antagonists, $5HT_1$ agonists, $5HT_3$ antagonists, COX2-inhibitors, steroids (e.g., prednisone, prednisolone, dexamethasone) medicaments used in treating psychiatric conditions such as depression, anxiety, bipolar condition, tranquilizers, medicaments used in treating metabolic conditions, anticancer medicaments, medicaments used in treating neurological conditions such as epilepsy and Parkinson's Disease, medicaments used in treating cardiovascular conditions, non-steroidal anti-inflammatory medicaments, medicaments used in treating Central Nervous System conditions, or medicaments employed in treating hepatitis.

The headings below are not meant to limit the disclosure in any way; embodiments under any one heading may be used in conjunction with embodiments under any other heading.

Reference will now be made in detail to certain embodiments of the invention, examples of which are illustrated in the accompanying drawings. While the invention will be described in conjunction with the illustrated embodiments, it will be understood that they are not intended to limit the invention to those embodiments.

Medicament Container

The present application provides new containers for medicaments that allow the container to be torn to dispense the medicament. Child-resistant containers for medicaments are also provided. The containers for medicaments allow product integrity for each individual dose of medicament, help with patient compliance and reduce the risk of medicament overdose.

The container for storage of the medicament can store the medicament until the container is opened. The medicament can be in the form of a pill, tablet, capsule, caplet, lozenge, troche, ointment, cream, liquid (e.g., suspension or solution) or gel. In some embodiments, single unit medicament containers can comprise sheets having separable units.

In one embodiment, there is a container for storage of a medicament, the container comprising a surface having at least one cavity configured to store at least one dose of the medicament; and a covering disposed over at least the cavity of the surface and comprising at least two adjacent edges and a set of perforations disposed on the covering and spaced apart from the at least two adjacent edges of the covering.

The surface can have a plurality of cavities therein to store the medicament. The cavity is covered and perforations can be in the surface and the covering in a diagonal. There is a crease adjacent to the diagonal perforations. The perforations are spaced from the edges of the covering and the surface so as to provide the packaging with some child-resistance. When the user tears along the perforations that are diagonal to the edges, a triangular piece is pulled apart from the container exposing a tab where the crease is. The user then tears along this tab in the direction of the crease; this force then tears the surface and the covering to dispense the medication.

In some embodiments, the container comprises a blister package. Blister packages are available to medicament users to easily store and dispense medicaments. Blister packages are useful for protecting products against external factors, such as humidity and contamination for extended periods of time. Opaque blisters also protect light-sensitive medicaments against radiation. In some cases, blister packages provide barrier protection for shelf life requirements. Blister packages may also provide a degree of tamper resistance and protection against mechanical forces. As used herein, the terms "blister package" and "blister pack" are used interchangeably.

FIGS. 1-3 illustrate an example of a container 10 for storage of a medicament shown as a blister package. Container 10 includes a first portion, such as, for example, a covering 12 and a second portion, such as, for example, a surface 14. The covering can be, in some embodiments, the lidding material for the container. In some embodiments, covering 12 may be formed from foil, paper, polymer, such as for example, polyester (PET), aluminum, cardboard, or a combination thereof. In some embodiments, the covering can have a thickness from about 0.1 mil. to about 1.5 mil. In some embodiments, container 10 extends longitudinally along a horizontal axis XX.

Surface 14 comprises at least one cavity 16 and a surrounding flange 18. The surface can be, in some embodiments, the forming film for the container. Typically, the forming film or a thermoformed film, or a thermoformed plastic sheet can be made from polymers comprising, for example, polyvinyl chloride (PVC), polypropylene (PP), polyester (PET), polyvinylidene chloride (PVDC), polystyrene (PS), oriented polyamide (OPA), nylon, aluminum, chlorotrifluoroethylene (CTFE), cyclic olefin copolymers (COC) or polymers (COP) or a combination thereof. The surface, in some embodiments, can comprise a thickness from about 0.5 mil to about 15 mil. The surface is shaped corresponding to the type of medicament it is to receive (e.g., circle, oblong, square, triangle, etc.). It can have a volume larger than the volume of the medicament it will receive (e.g., capsule, tablet, mini-tablet, liquid etc.)

As shown in FIGS. 1-2, surface 14 includes six cavities 16, each having a surrounding flange. Cavities 16 are configured in a side-by-side arrangement such that container 10 comprises two rows of cavities aligned on a vertical axis YY, each row having three cavities aligned on horizontal axis XX. However, in other embodiments surface 14 may contain more or less cavities 16 than that shown in FIGS. 1-2. For example, container 10 may have two, four, eight, ten, twelve, fourteen, sixteen, eighteen or twenty cavities 16 in a side-by-side arrangement. Alternatively, container 10 may have other configurations, such as having cavities 16 arranged in a single row or in three, four, five, six, seven, eight, nine or ten rows analogous to the arrangement shown in FIGS. 1-2.

In some embodiments, cavity 16 has a circular shape. However, in other embodiments, cavity 16 may have other shapes to facilitate storage of complementary shaped medicaments. For example, in various embodiments, cavity 16 can be elliptical, pill-shaped, square, rectangular, dome shaped, triangular, polygonal or irregular. In one embodiment, cavity 16 comprises three circular segments such that each segment defines a different diameter than the preceding segment. The segments have decreasing diameters such that the lower segments have a smaller diameter than the upper segments.

The shapes of the cavities can be based on the type and form of the medicament stored. For example, oval shapes can be used for storage of unit dose liquid suspensions or solutions. Bar shapes can be used for storage of, for example, ointments or creams.

Cavity 16 can be surrounded by flange 18. Flange 18 and cavity 16 of the surface 14 allows the area for the covering 12 to be disposed on them once the medicament is loaded in the cavity 16. Therefore, in this embodiment, covering 12 is the top of the medicament container and the surface 14 having cavity 16 is the bottom of the medicament container.

In one embodiment, flange 18 is configured to provide resistance to being manipulated by a child. For example, in such an embodiment, flange 18 has a smooth surface that is free or substantially free of protrusions to make gripping the flange more difficult for a child. In another embodiment, flange 18 is configured to facilitate gripping for easily opening container 10. In such an embodiment, flange 18 may have alternate surface configurations, such as, for example, rough, arcuate, undulating, mesh, porous, semi-porous, dimpled and/or textured to facilitate gripping by a user.

In some embodiments, the container 10 for storage of the medicament can be child-resistant packaging that can provide some child-resistance to opening. Child-resistant packing includes packaging that is constructed to be difficult for children under five years of age to open or obtain a toxic or harmful amount of the medicament stored therein within a reasonable time (e.g., 5 to 10 minutes) and not difficult for normal adults to open properly. These include Type IV, VIII, or XIII strips, pouches, or blister type packages.

In one embodiment, cavity 16 is centered about flange 18. In another embodiment, cavity 16 is offset from the center. In some embodiments, cavity 16 is centered along a horizontal axis XX but not a vertical axis YY. In some embodiments, cavity 16 is centered along a vertical axis YY but not a horizontal axis XX.

In one embodiment, container 10 comprises a sheet of separable units 20. Separable units 20 comprise a container having a cavity 16 surrounded by flange 18. Separable units 20 are divided by perforated lines, such as vertical perforations 22 and horizontal perforations 24. Vertical perforations 22 run parallel with vertical axis YY, and horizontal perforations 24 run parallel with horizontal axis XX. In the embodiment shown in FIG. 1, there are two vertical perforations 22 and a single horizontal perforation 24 to create six separable units 20 configured in a side-by-side arrangement, as discussed herein. Vertical perforation 22 and horizontal perforation 24 are configured to pass through covering 12 and surface 14. However, in other embodiments, vertical perforation 22 and horizontal perforation 24 are configured to pass through only one of covering 12 or surface 14.

As shown in enlarged portion C in FIG. 3, each separable unit 20 comprises at least two adjacent edges and a set of perforations 26 disposed on the covering. Set of perforations 26 is spaced apart from the at least two adjacent edges 21 and 23 at space 25, which is next to adjacent edges 21 and 23. Space 25 prevents the set of perforations from extending to the two adjacent edges 21 and 23. The perforations are configured to create a line to enable a user to easily tear along the perforations. The presence of space 25 facilitates the tamper resistance of set of perforations 26. In one embodiment, space 25 requires a greater amount of force to tear through than set of perforations 26. This feature facilitates child resistance yet allows an adult to easily open and access medicaments held within the container. This provides some child-resistance to the packing as explained below.

Set of perforations 26 extends between adjacent edges 21 and 23 defined by vertical perforation 22 and horizontal perforation 24. In one embodiment, set of perforations 26 extends at an equivalent angle from each of the adjacent edges. In one embodiment, set of perforations 26 extends at an angle of 45° from each adjacent edge. Set of perforations 26 extends diagonally between the adjacent edges to form a tab 28. Tab 28 is separable from container 10 once a user tears along set of perforations 26, as discussed herein. In some embodiments, set of perforations 26 comprises a single perforation, or a plurality of perforations. Set of perforations 26 is configured to pass through covering 12 and surface 14. However, in other embodiments, set of perforations 26 is configured to pass through only one of covering 12 or surface 14.

Set of perforations 26 is spaced apart from the adjacent edges such that set of perforations 26 does not extend all the way to the adjacent edges. That is, set of perforations 26 is separated from the edges by space 25. The perforations are configured to create a line to enable a user to easily tear along the perforations. The presence of space 25 facilitates the tamper resistance of set of perforations 26. In one embodiment, space 25 requires a greater amount of force to tear through than set of perforations 26. This feature facilitates child resistance yet allows an adult to easily open and access medicaments held within the container.

The space 25 between the adjacent edges 21 and 23 and the first perforation of the set of perforations 26 can be from about 0.05 mm, 0.1, 0.15 0.2, 0.25, 0.3, 0.4, 0.5, 0.6, 0.7, 0.75, 0.8, 0.9, 1.0, 1.5, 2.0, 2.5, 3.0, 3.5, 4.0 mm in length between adjacent edge and the first perforation.

In one embodiment, each separable unit 20 on container 10 has a first set of perforations 26 positioned in one corner and an additional set of perforations positioned in another corner. For example, a first set of perforations 26 may be positioned in a corner as shown in FIGS. 1-3 and an additional set of perforations is positioned in an opposite corner such that the sets of perforations 26 are aligned and substantially parallel to each other. In another embodiment, a first set of perforations 26 may be positioned in a corner as seen in FIGS. 1-3 and an additional set of perforations is positioned in an adjacent corner such that the sets of perforations 26 are next to each other. In other embodiments, three corners comprise sets of perforations 26. In other embodiments, each of the four corners comprises sets of perforations 26.

Container 10 includes a crease 30 disposed adjacent to set of perforations 26. The crease, in some embodiments, can be a notch. In one embodiment, crease 30 is positioned between set of perforations 26 and cavity 16, as shown, for example, in FIG. 1. In one embodiment, crease 30 comprises a single perforation oriented transverse to set of perforations 26. In other embodiments, crease 30 comprises a plurality of perforations oriented in a line transverse to set of perforations 26. Crease 30 is configured to pass through covering 12 and surface 14. However, in other embodiments, crease 30 is configured to pass through only one of covering 12 or surface 14. When the container is torn along the set of perforation 26, the spaces 25, provide some child resistance. In some embodiments, once the set of perforations 26 is torn, it will expose a tearing assist at crease 30, that allows the user to tear the container along crease 30 to tear the covering (e.g., lid) and the surface (e.g., forming film) to dispense the medicament from the cavity. By inspecting the container, the user (e.g., patient, caregiver, etc.) will know that the dose was dispensed and that the medicament is ready to be consumed. In this way, the integrity of the product and patient compliance can be enhanced as well as accidental misuse of the medicament by over-dose can be avoided.

Figure 5:
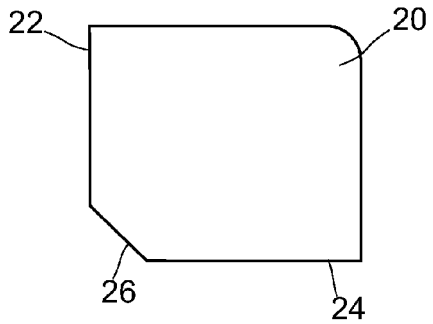
FIG. 5 illustrates a top view of a covering of a separable unit separated from the blister package sheet as shown in FIG. 4, wherein the tab has been removed from the separable unit.

As shown in FIGS. 4-5, separable units 20 may be separated from container 10 one by one. Each set of perforations 26 is spaced apart from vertical perforation 22 and horizontal perforation 24 by spaces 25 such that when pulled apart by a user, the separation of unit 20 from container 10 will not cause the separation of tab 28. Such a configuration facilitates tamper resistance and child resistance even after a separable unit 20 has been torn from container 10.

Tabs 28 are oriented to face in toward other tabs 28 on adjacent separable units 20. In one embodiment, an individual tab 28 forms a triangular shape such that when tabs 28 of adjacent separable units 20 are aligned, tabs 28 form a larger triangular shape, a square shape or a diamond shape. In another embodiment, tab 28 is oriented to face the outer perimeter of container 10. Such an embodiment facilitates a user to access a medicament held within cavity 16 without separating separable unit 20 from container 10.

Once tab 28 is separated from separable unit 20, in some embodiments, crease 30 is exposed to be manipulated by a user. Alternatively, in some embodiments, once the set of perforations 26 is torn, it will expose a tearing assist at crease 30, that allows the user to tear the container along crease 30 to tear the covering (e.g., lid) and the surface (e.g., forming film) to dispense the medicament from the cavity.

Crease 30 is configured to be partially split during or after the separation of separable unit 20, as discussed herein. Crease 30 establishes a tear trajectory to facilitate tearing of separable unit 20 through cavity 16 to dispense the medicament held therein. Crease 30, in some embodiments, is positioned at the midpoint of set of perforations 26. Such a configuration allows a user to grip separable unit 20 on either side of crease 30 to split crease 30 and tear open the separable unit 20 through cavity 16.

Figure 6:
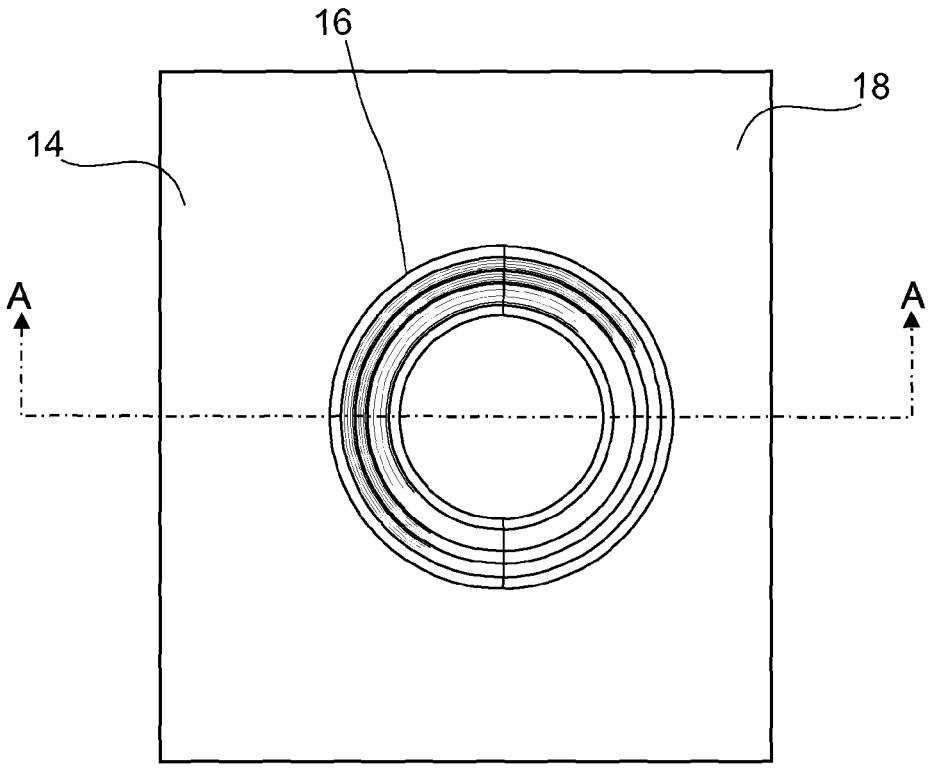
FIG. 6 illustrates a top view of a surface as described herein having a cavity as shown in FIG. 1.
Figure 7:
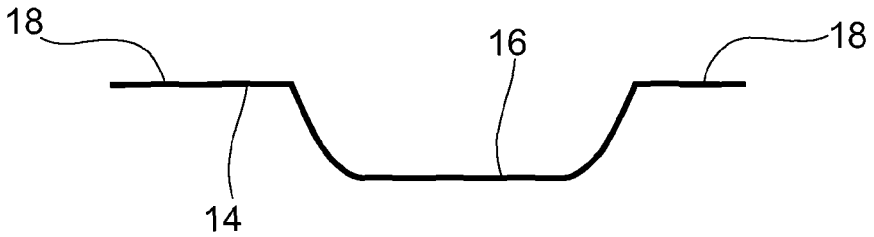
FIG. 7 illustrates a side cross sectional view of components of a surface having a cavity along its cross section as shown in FIG. 6.
Figure 8:
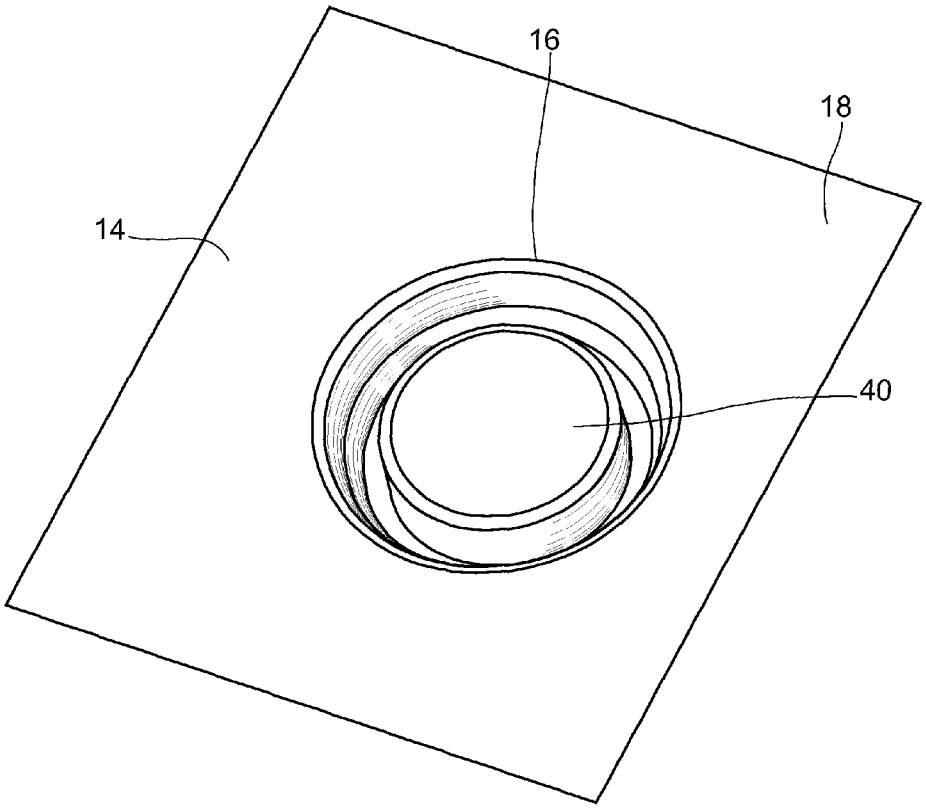
FIG. 8 illustrates components of a surface having a cavity containing a medicament within the cavity.

As shown in FIGS. 6-8, cavity 16 is configured to receive a medicament 40. In various embodiments, medicament 40 comprises a pill, tablet, capsule, liquid, powder, or other forms of administrable medication. In some embodiments, cavity 16 has a circular shape. However, in other embodiments, cavity 16 may have other shapes to facilitate storage of complementary shaped medicaments. For example, in various embodiments, cavity 16 can be elliptical, pill-shaped, square, rectangular, dome shaped, triangular, polygonal or irregular. Cavity 16 may be adapted to receive various sizes and shapes of medicaments. Cavity 16 includes sidewalls that decrease in diameter from top to bottom. Such a configuration is adapted to hold in place a medicament 40 having a range of diameters. However, in other embodiments, the sidewalls may be perpendicular to flange 18 such that cavity 16 defines a cylindrical shape.

In some embodiments, cavity 16 comprises a number of circular segments such that each segment defines a different diameter than the preceding segment. The segments have decreasing diameters such that the bottom segments have a steeper pitch than the upper segments. In one embodiment, the pitch of the segments can range between 20° and 70°. In one embodiment, the pitch of a first segment is between 60° and 70°, the pitch of a second segment is between 40° and 50°, and the pitch of a third segment is between 20° and 30°. In one embodiment, the pitch of a first segment is 62°, the pitch of a second segment is 40°, and the pitch of a third segment is 28°. Cavity 16 has a depth adapted to receive various medicaments. In some embodiments, cavity 16 has a depth between 1 mm and 100 mm, 1 mm and 50 mm, 1 mm and 10 mm, 10 mm and 20 mm, 20 mm and 30 mm, 30 mm and 40 mm, 40 mm and 50 mm, 50 mm and 60 mm, 60 mm and 70 mm, 70 mm and 80 mm, 80 mm and 90 mm, or 90 mm and 100 mm.

In other embodiments, a separable unit 20 comprises a plurality of cavities capable of storing one or more medicaments 40 each. In some embodiments, each separable unit may comprise two, three, four or more cavities 16. The cavities 16 on the separable unit 20 may each be circular or may be variously shaped.

Methods of Use

The present disclosure also provides methods of using a blister package to dispense a medicament stored therein.

Figure 9:
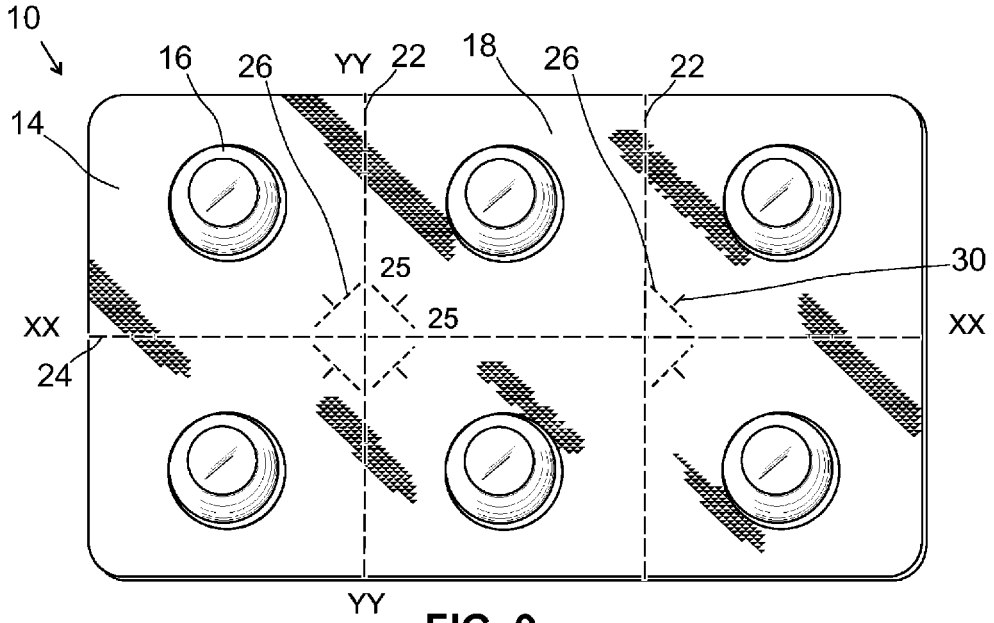
FIG. 9 illustrates a bottom view of a blister package sheet having separable units divided by perforations extending along a horizontal axis XX and a vertical axis YY, wherein each separable unit has a cavity for storage of a medicament, a tab that is removable from the separable unit, and a crease for tearing the separable unit.

As shown in FIGS. 9-13, a container 10 includes a first portion, such as, for example, a covering 12 and a second portion, such as, for example, a surface 14. In some embodiments, covering 12 may be formed from foil, paper, cardboard or a combination thereof. Surface 14 comprises at least one cavity 16 and a surrounding flange 18. As shown in FIG. 9, surface 14 includes six cavities 16, each having a surrounding flange 18. Cavities 16 are configured in a side-by-side arrangement such that container 10 comprises two rows of cavities 16, each row having three cavities. The container can have only 1 dose of the medicament in solid or liquid form in one card.

In one embodiment, container 10 comprises a sheet of separable units 20. Each separable unit 20 comprises a container having a cavity 16 surrounded by flange 18. Separable units 20 are divided by perforated lines, such as vertical perforations 22 and horizontal perforations 24. In one embodiment, there are two vertical perforations 22 and a single horizontal perforation 24 to create six separable units 20 configured in a side-by-side arrangement, as discussed herein. Vertical perforation 22 and horizontal perforation 24 are configured to pass through both covering 12 and surface 14. However, in other embodiments, vertical perforation 22 and horizontal perforation 24 are configured to pass through only one of either covering 12 or surface 14.

Each separable unit 20 comprises at least two adjacent edges and a set of perforations 26 disposed on the covering and spaced apart from the at least two adjacent edges. Set of perforations 26 extends between adjacent edges defined by vertical perforation 22 and horizontal perforation 24. In one embodiment, set of perforations 26 extends at an equivalent angle from each of the adjacent edges. In one embodiment, set of perforations 26 extends at an angle of 45° from each adjacent edge. Set of perforations 26 extends diagonally between the adjacent edges to form a tab 28. In some embodiments, set of perforations 26 comprises a single perforation, or a plurality of perforations. Set of perforations 26 is configured to pass through both covering 12 and surface 14. However, in other embodiments, set of perforations 26 is configured to pass through only one of either covering 12 or surface 14.

Each set of perforations 26 is spaced apart from vertical perforation 22 and horizontal perforation 24 by spaces 25 such that when pulled apart by a user, the separation of unit 20 from container 10 will not cause the separation of tab 28. Such a configuration facilitates tamper resistance and child resistance even after a separable unit 20 has been torn from container 10.

Crease 30 is configured to be partially split during or after the separation of separable unit 20, as discussed herein. Crease 30 establishes a tear trajectory to facilitate tearing of separable unit 20 through cavity 16 to dispense the medicament held therein. Crease 30 is positioned at the midpoint of set of perforations 26. Such a configuration allows a user to grab separable unit 20 on either side of crease 30 to split crease 30 and tear open the separable unit 20 through cavity 16.

Figure 10:
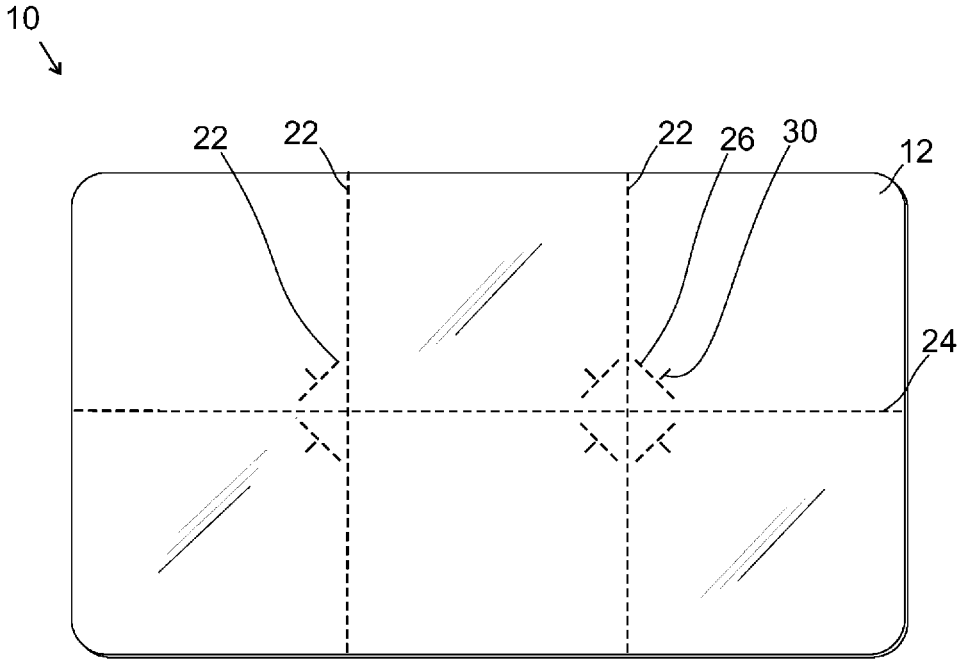
FIG. 10 illustrates top view of a covering for a blister package sheet having separable units as shown in FIG. 9, wherein the covering has space to include printed information for use by a user of the medicament.
Figure 11:
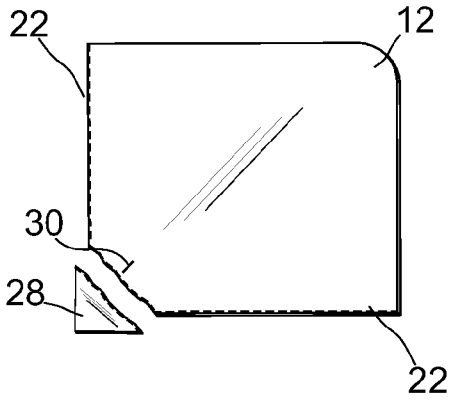
FIG. 11 illustrates a top view of a separable unit separated from the blister package sheet shown in FIG. 9, the separable unit having a tab removed to expose a crease for tearing the unit.
Figure 12:
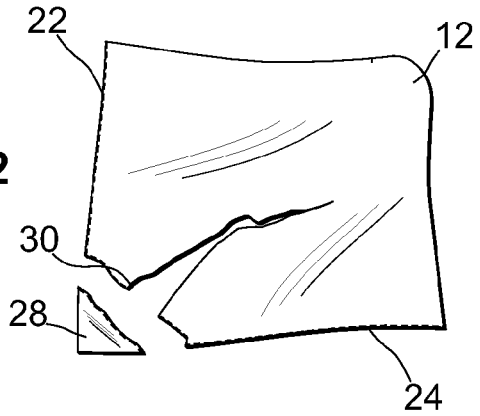
FIG. 12 illustrates a top view of a separable unit separated from the blister package sheet shown in FIG. 9 with the crease parted to tear the unit and the covering is torn to dispense the medicament.
Figure 13:
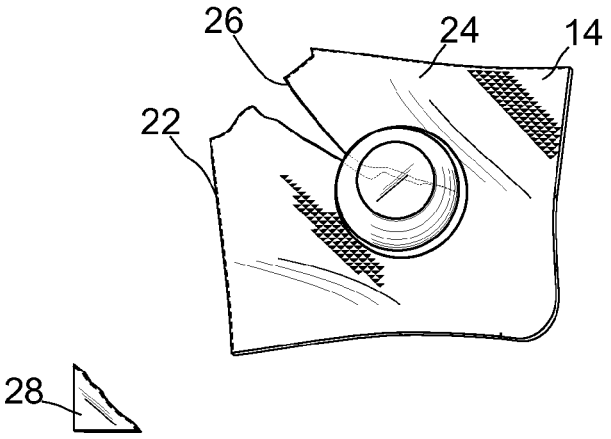
FIG. 13 illustrates a bottom view of a separable unit separated from the blister package sheet shown in FIG. 9 with the crease on the covering torn and the surface torn to allow the medicament to be dispensed from the cavity of the surface.

In use, a container 10 is torn open to dispense a medicament held therein. Container 10 is manipulated so that a separable unit 20 is separated from container 10 by tearing a portion of vertical perforation 22 and horizontal perforation. As shown in FIGS. 9-10, vertical perforation 22 and horizontal perforation 24 are torn to a point where vertical perforation 22 and horizontal perforation 24 meet.

Tab 28 is manipulated by a user through bending or twisting along set of perforations 26 to weaken the perforations. Tab 28 is continuously manipulated and pulled until set of perforations 26 separates. Gripping tab 28 and separable unit 20, a user applies a force to tab to overcome the tensile strength of portions of tab 28 joined to separable unit 20 at spaces 25. Tab 28 and separable unit 20 are configured to be gripped by the hands of a user or medical practitioner or a tool suitable to separate tab 28 from separable unit 20. Once the set of perforations 26 is torn, in some embodiments, it will expose a tearing assist at crease 30 or notch, that allows the user to tear the container along crease 30 to tear the covering (e.g., lid) and the surface (e.g., forming film, or a thermoformed film, or a thermoformed plastic sheet) to dispense the medicament from the cavity.

In one embodiment, crease 30 is configured such that as set of perforations 26 is manipulated to be weakened, crease 30 partially separates to create a tear path. After tab 28 is removed from separable unit 28, crease 30 is exposed. A user grips both sides of crease 30 and applies a force to split separable unit 20 along the tear line partially established by crease 30. Separable unit 20 is torn such that cavity 16 is torn to expose medicament 40 such that it can be gripped or caught by a user.

It will be apparent to those skilled in the art that various modifications and variations can be made to various embodiments described herein without departing from the spirit or scope of the teachings herein. Thus, it is intended that various embodiments cover other modifications and variations of various embodiments within the scope of the present teachings.

Medicaments

The medicament stored in the blister package may include substances traditionally regarded as actives, drugs and bioactive agents, as well as biopharmaceuticals (e.g., peptides, hormones, nucleic acids, gene constructs, etc.) typically employed to treat a number of conditions which is defined broadly to encompass diseases, disorders, infections, and the like. Exemplary medicaments include, without limitation, antibiotics, antivirals, H2-receptor antagonists, 5HT1 agonists, 5HT3 antagonists, COX2-inhibitors, medicaments used in treating psychiatric conditions such as depression, anxiety, bipolar condition, tranquilizers, medicaments used in treating metabolic conditions, anticancer medicaments, medicaments used in treating neurological conditions such as epilepsy and Parkinson's Disease, medicaments used in treating cardiovascular conditions, non-steroidal anti-inflammatory medicaments, medicaments used in treating Central Nervous System conditions, and medicaments employed in treating hepatitis.

Appropriate medicaments may thus be selected from, for example, analgesics, e.g., codeine, dihydromorphine, ergotamine, fentanyl or morphine; anginal preparations, e.g., diltiazem; antiallergics, e.g., cromoglycate (e.g. as the sodium salt), ketoprofen or nedocromil (e.g. as the sodium salt); antiinfectives e.g., cephalosporins, penicillins, streptomycin, sulphonamides, tetracyclines and pentamidine; antihistamines, e.g., methapyrilene; anti-inflammatories, e.g., beclomethasone (e.g. as the dipropionate ester), fluticasone (e.g. as the propionate ester), flunisolide, prednisone, prednisolone, budesonide, rofleponide, mometasone e.g. as the furoate ester), ciclesonide, triamcinolone (e.g. as the acetonide) or 6α,9α-difluoro-11β-hydroxy-16α-methyl-3-oxo-17α-propionyloxy-androsta-1,4-diene-17β-carbothioic acid S-(2-oxo-tetrahydro-furan-3-yl)ester; antitussives, e.g., noscapine; bronchodilators, e.g., albuterol (e.g. as free base or sulphate), salmeterol (e.g. as xinafoate), ephedrine, adrenaline, fenoterol (e.g. as hydrobromide), formoterol (e.g. as fumarate), isoprenaline, metaproterenol, phenylephrine, phenylpropanolamine, pirbuterol (e.g. as acetate), reproterol (e.g. as hydrochloride), rimiterol, terbutaline (e.g. as sulphate), isoetharine, tulobuterol or 4-hydroxy-7-[2-[[2-[[3-(2-phenylethoxy)propyl]sulfonyl]ethyl]amino]ethyl-2(3H)-benzothiazolone; adenosine 2a agonists, e.g. 2R,3R,4S,5R)-2-[6-Amino-2-(1S-hydroxymethyl-2-phenylethylamino)purin-9-yl]-5-(2-ethyl-2H-tetrazol-5-yl)-tetrahydro-furan-3,4-diol (e.g. as maleate); α4 integrin inhibitors e.g. (2S)-3-[4-({[4-(aminocarbonyl)-1-piperidinyl]carbonyl}oxy)phenyl]-2-[((2S)-4-methyl-2-{[2-(2-methylphenoxy)acetyl]amino}pentanoyl)amino]propanoic acid (e.g. as free acid or potassium salt), diuretics, e.g., amiloride; anticholinergics, e.g., ipratropium (e.g. as bromide), tiotropium, atropine or oxitropium; hormones, e.g., cortisone, hydrocortisone or prednisolone; xanthines, e.g., aminophylline, choline theophyllinate, lysine theophyllinate or theophylline; therapeutic proteins and peptides, e.g., insulin or glucagon; vaccines, diagnostics, and gene therapies. It will be clear to a person skilled in the art that, where appropriate, the medicaments may be used in the form of salts, (e.g., as alkali metal or amine salts or as acid addition salts) or as esters (e.g., lower alkyl esters) or as solvates (e.g., hydrates) to optimize the activity and/or stability of the medicament.

Additionally, appropriate medicaments may be selected from, for example, antibiotics. Such antibiotics include, for example, nitroimidazole antibiotics, tetracyclines, penicillins, cephalosporins, carbopenems, aminoglycosides, macrolide antibiotics, lincosamide antibiotics, 4-quinolones, rifamycins and nitrofurantoin. In the following examples of such antibiotics are listed: ampicillin, amoxicillin, benzylpenicillin, phenoxymethylpenicillin, bacampicillin, pivampicillin, carbenicillin, cloxacillin, cyclacillin, dicloxacillin, methicillin, oxacillin, piperacillin, ticarcillin, flucloxacillin, cefuroxime, cefetamet, cefetrame, cefixine, cefoxitin, ceftazidime, ceftizoxime, latamoxef, cefoperazone, ceftriaxone, cefsulodin, cefotaxime, cephalexin, cefaclor, cefadroxil, cefalothin, cefazolin, cefpodoxime, ceftibuten, aztreonam, tigemonam, erythromycin, dirithromycin, roxithromycin, azithromycin, clarithromycin, clindamycin, paldimycin, lincomycirl, vancomycin, spectinomycin, tobramycin, paromomycin, metronidazole, tinidazole, ornidazole, amifloxacin, cinoxacin, ciprofloxacin, difloxacin, enoxacin, fleroxacin, norfloxacin, ofloxacin, temafloxacin, doxycycline, minocycline, tetracycline, chlortetracycline, oxytetracycline, methacycline, rolitetracyclin, nitrofurantoin, nalidixic acid, gentamicin, rifampicin, amikacin, netilmicin, imipenem, cilastatin, chloramphenicol, furazolidone, nifuroxazide, sulfadiazin, sulfametoxazol, bismuth subsalicylate, colloidal bismuth subcitrate, gramicidin, mecillinam, cloxiquine, chlorhexidine, dichlorobenzylalcohol, methyl-2-pentylphenol. The active antibiotics could be in standard forms or used as salts, hydrates, esters etc. A combination of two or more of the above listed drugs may be used. Preferable antibiotics are clarithromycin, erythromycin, roxithromycin, azithromycin, amoxicillin, metronidazole, tinidazole and tetracycline. Clarithromycin and metronidazole alone or in combination are especially suitable.

Moreover, appropriate medicaments may be selected from, for example, antivirals. Examples of medicaments that are effective for the treatment of viral and viral associated conditions are (1-alpha, 2-beta, 3-alpha)-9-[2,3-bis(hydroxymethyl)cyclobutyl]guanine [(−)BHCG, SQ-34514, lobucavir], 9-[(2R,3R,4S)-3,4-bis(hydroxymethyl)-2-oxetanosyl]adenine (oxetanocin-G), acyclic nucleosides, for example acyclovir, valaciclovir, famciclovir, ganciclovir, and penciclovir, acyclic nucleoside phosphonates, for example (S)-1-(3-hydroxy-2-phosphonyl-methoxypropyl) cytosine (HPMPC), [[[2-(6-amino-9H-purin-9-yl)ethoxy] methyl]phosphinylidene]bis(oxymethylene)-2,2-dimethyl-propanoic acid (bis-POM PMEA, adefovir dipivoxil), [[(1R)-2-(6-amino-9H-purin-9-yl)-1-methylethoxy]methyl] phosphonic acid (tenofovir), and (R)-[[2-(6-Amino-9H-purin-9-yl)-1-methylethoxy]methyl]phosphonic acid bis-(isopropoxy carbonyloxymethyl)ester (bis-POC-PMPA), ribonucleotide reductase inhibitors, for example 2-acetylpyridine 5-[(2-chloroanilino)thiocarbonyl)thiocarbonohydrazone and hydroxyurea, nucleoside reverse transcriptase inhibitors, for example 3'-azido-3'-deoxythymidine (AZT, zidovudine), 2',3'-dideoxycytidine (ddC, zalcitabine), 2',3'-dideoxyadenosine, 2',3'-dideoxyinosine (ddI, didanosine), 2',3'-didehydrothymidine (d4T, stavudine), (−)-beta-D-2,6-diaminopurine dioxolane (DAPD), 3'-azido-2',3'-dideoxythymidine-5'-H-phosphophonate (phosphonovir), 2'-deoxy-5-iodo-uridine (idoxuridine), (−)-cis-1-(2-hydroxymethyl)-1,3-oxathiolane 5-yl)-cytosine (lamivudine), cis-1-(2-(hydroxymethyl)-1,3-oxathiolan-5-yl)-5-fluorocytosine (FTC), 3'-deoxy-3'-fluorothymidine, 5-chloro-2',3'-dideoxy-3'-fluorouridine, (−)-cis-4-[2-amino-6-(cyclopropylamino)-9H-purin-9-yl]-2-cyclopentene-1-methanol (abacavir), 9-[4-hydroxy-2-(hydroxymethyl)but-1-yl]-guanine (H2G), ABT-606 (2HM-H2G) and ribavirin, protease inhibitors, for example indinavir, ritonavir, nelfinavir, amprenavir, saquinavir, (R)-N-tert-butyl-3-[(2S,3S)-2-hydroxy-3-N-[(R)-2-N-(isoquinolin-5-yloxyacetyl)amino-3-methylthio-propanoyl]amino-4-phenylbutanoyl]-5,5-dimethyl-1,3-thiazolidine-4-carboxamide (KNI-272), 4R-(4alpha,5alpha,6beta)]-1,3-bis[(3-aminophenyl)methyl] hexahydro-5,6-dihydroxy-4,7-bis(phenylmethyl)-2H-1,3-diazepin-2-one dimethanesulfonate (mozenavir), 3-[1-[3-[2-(5-trifluoromethylpyridinyl)-sulfonylamino]phenyl] propyl]-4-hydroxy-6alpha-phenethyl-6beta-propyl-5,6-dihydro-2-pyranone (tipranavir), N'-[2(S)-Hydroxy-3(S)-[N-(methoxycarbonyl)-I-tert-leucylamino]-4-phenylbutyl-Nalpha-(methoxycarbonyl)-N'-[4-(2-pyridyl)benzyl]-L-tert-leucylhydrazide (BMS-232632), 3-(2(S)-Hydroxy-3(S)-(3-hydroxy-2-methylbenzamido)-4-phenylbutanoyl)-5,5-dimethyl-N-(2-methylbenzyl)thiazolidine-4(R)-carboxamide (AG-1776), N-(2(R)-hydroxy-1(S)-indanyl)-2(R)-phenyl-methyl-4(S)-hydroxy-5-(1-(1-(4-benzo[b] furanylmethyl)-2(S)-N'-(tert-butylcarboxamido) piperazinyl)pentanamide (MK-944A), and (3S)-tetrahydrofuran-3-yl(1S,2R)-[[(4-aminophenyl)sulphonyl)] (isobutyl)amino]-1-benzyl-2-(phosphonooxy) propylcarbamate monocalcium salt (fosamprenavir), interferons such as α-interferon, renal excretion inhibitors such as probenecid, nucleoside transport inhibitors such as dipyridamole; pentoxifylline, N-acetylcysteine (NAC), Procysteine, α-trichosanthin, phosphonoformic acid, as well as immunomodulators such as interleukin II or thymosin, granulocyte macrophage colony stimulating factors, erythropoetin, soluble CD4 and genetically engineered derivatives thereof, non-nucleoside reverse transcriptase inhibitors (NNRTIs), for example nevirapine (BI-RG-587), alpha-((2-acetyl-5-methylphenyl)amino)-2,6-dichloro-benzeneacetamide (loviride), 1-[3-(isopropylamino)-2-pyridyl]4-[5-(methanesulfonamido)-1H-indol-2-ylcarbonyl]piperazine monomethanesulfonate (delavirdine), (10R,11S,12S)-12-Hydroxy-6,6,10,11-tetramethyl-4-propyl-11,12-dihydro-2H,6H,10H-benzo(1,2-b:3,4-b':5,6-b")tripyran-2-one ((+) calanolide A), (4S)-6-Chloro-4-[1E)-cyclopropylethenyl)-3,4-dihydro-4-(trifluoromethyl)-2(1H)-quinazolinone (DPC-083), (S)-6-chloro-4-(cyclopropylethynyl)-1,4-dihydro4-(trifluoromethyl)-2H-3,1-benzoxazin-2-one (efavirenz, DMP 266), 1-(ethoxymethyl)-5-(1-methylethyl)-6-(phenylmethyl)-2,4(1H,3H)-pyrimidinedione (MKC-442), and 5-(3,5-dichlorophenyl)thio-4-isopropyl-1-(4-pyridyl)methyl-1H-imidazol-2-ylmethyl carbamate (capravirine), glycoprotein 120 antagonists, for example PRO-2000, PRO-542 and 1,4-bis[3-[(2,4-dichlorophenyl)carbonylamino]-2-oxo-5,8-disodiumsulfanyl]naphthalyl-2,5-dimethoxyphenyl-1,4-dihydrazone (FP-21399), cytokine antagonists, for example reticulose (Product-R), 1,1'-azobis-formamide (ADA), 1,11-(1,4-phenylenebis(methylene))bis-1,4,8,11-tetraazacyclotetradecane octahydrochloride (AMD-3100), integrase inhibitors, for example, S-1360, and fusion inhibitors.

The medicament may also include pharmaceutically acceptable salts, esters, solvates, and/or hydrates of the pharmaceutically active substances referred to hereinabove. Various combinations of any of the above medicaments may also be employed.

In various embodiments, the medicament may be employed in an oral pharmaceutical formulation. An oral pharmaceutical formulation typically refers to the combination of at least one medicament and one or more added components or elements, such as an excipient or carrier. Examples of normally employed excipients, include pharmaceutical grades of carbohydrates, including monosaccharides, disaccharides, cyclodextrins and polysaccharides (e.g., dextrose, sucrose, lactose, raffinose, mannitol, sorbitol, inositol, dextrins and maltodextrins); starch; cellulose; salts (e.g., sodium or calcium phosphates, calcium sulfate, magnesium sulfate); citric acid; tartaric acid; glycine; leucine; high molecular weight polyethylene glyols (PEG); pluronics; surfactants; lubricants; stearates and their salts or esters (e.g., magnesium stearate); amino acids; fatty acids; and combinations thereof.

The oral pharmaceutical formulation may be utilized in a variety of unit dosage forms including, without limitation, a tablet, a pill, a capsule, a lozenge, and combinations thereof. The unit dosage forms may encompass hospital unit dosage forms, as well as others.

Materials

Various materials may be used in forming the components of the present disclosure. Examples materials include various materials formed from polymers that may include, without limitation, polyvinyl chloride, polyvinylidene chloride, polypropylene, polyethylene, polychlorotrifluoroethylene, and combinations thereof.

The blister package may also be made from cellophane. Cellophane has a low cost, proven reliability in packaging medicament products, transparency, moisture-proof capabilities and other valuable features. However, other known plastic films can be used, as long as they have the characteristics required.

In various embodiments, surface 14 is made by a strong, rigid and opaque multi-layered material, such as a combination of one or more layers of PVC, OPA and aluminum foil, held together by layers of adhesive. Surface 14 has a substantial thickness between 150 to 300 microns, more preferably between 200 and 250 microns, to provide protection the contents of the blisters. Cavity 16 of each of the unit package region 3 is integrally formed in the container sheet, and may be of any desired size or configuration, preferably round or oval, depending on the product to be stored. Cavity 16 may have different depths also depending on the product. In a preferred embodiment cavity 16 forms a blister with a depth of 5 to 15 millimeters.

Covering 12 of the blister package may include various materials, non-limiting embodiments including cellulose, polymer, metal, as well as combinations thereof. In one embodiment, the covering includes a metallic foil layer secured to the surface and enclosing the opening of the blisters. Covering 12 may be configured to be rupturable upon manual compression of a blister containing medicament by a patient who releases the medicament. If employed, a metallic foil preferably comprises aluminum. In one embodiment, a first layer, formed from any of the materials set forth herein, is preferably backed by a second layer, preferably containing paperboard, such that the covering is preferably present as a laminate. The covering may be attached to the film using a technique which is accepted in the art.

In some embodiments, covering 12 comprises an aluminium foil sheet having multiple layers. The aluminium sheets are selected to have sufficient thickness to be substantially free of 'pinhole' imperfections thereby making them essentially impermeable to the transfer of moisture. In some embodiments, laminate form sheets are used for either one or multiple layers for covering 12. The laminates may comprise a layer of aluminium foil and one or more polymeric layers.

The thickness range of covering 12, in some embodiments, can be between about 30 and 100 millimeters, or between 30 and 50 millimeters. A paper layer is optional and may allow print to be placed on the blister pack. The multi-layered laminate forming the closure sheet may have two or more layers including the adhesive bond layer between the different components. In one embodiment, the closure sheet has three layers excluding the adhesive bond layers. The external side of the closure sheet may serve as a label, providing a complete label on the back of each individual unit package region. The label may include the name of the medicament, the lot number, the expiration date, and directions for opening the blister card package sections, or other important identifying information. The other side of the closure sheet may have special coating to protect the contents of the cavities from moisture and water.

Method of Manufacture

In one embodiment, the blister package comprises a molded plastic or has a plurality of individual medicament receiving cavities. Suitably, the blister package or components of the blister package may be formed by vacuum molding. In other embodiments, the blister package can be manufactured using any of several manufacturing techniques, such as injection molding, blow molding, press molding, and/or stamping. An example of a method for making a container 10 can include providing a first mold and then injecting material into the first mold to form components of a blister package, such as, for example, surface 14 having one or more cavities 16. The mold can then be opened and the components of the blister package including the surface 14 can be removed from the mold.

In other embodiments, the blister package or components of the blister package are cold formed from a sheet material. This approach may be used where the sheet material can be plastically deformed sufficiently to create the blister package without the sheet material rupturing or pin holing. A suitable material for this would be aluminum foil laminated on both sides with a suitable lacquer to provide the required functional performance for forming a container for the medicament. Thus, one side of components of the blister package, such as, for example surface 14, would have an adhesive lacquer to which the lidding foil would be sealed and the other side would have one or more lacquers whose function could be selected for: protection of the metal foil from corrosion, strengthening during forming, or decorative appearance etc.

In some embodiments, the blister package or components of the blister package, such as, for example covering 12, can be made from a paper composite material, metal, plastic or combination of materials. In particular, the components of the blister package can include a rupturable foil backing with a plastic bubble portion located over medicament 40. A paper or paper board can be interposed between the foil and plastic, or the foil can be interposed between the paper/ paperboard and plastic. In some embodiments, the disclosed lidstock material is manufactured utilizing lamination and coating. In the lamination process, the release adhesive is applied to the foil web by gravure cylinder coating. The adhesive is solvent based and the solvent is removed by taking the foil through an oven. In particular embodiments, oven temperatures are set at about 150-180° Fahrenheit to remove the solvent. The heat seal is then applied to the foil by gravure cylinder coating. The heat seal is solvent based and the solvent is removed by taking the foil through an oven. In particular embodiments, oven temperatures are set at about 275° F. to remove the solvent.

Indicia can be printed on the covering 12 to provide instructions for use, warnings, and the like. Alternatively, a separate instructional page or booklet could be pivoted in and/or connected with or within the blister package. Thus, information such as drug interaction information, accidental ingestion information, dosage instructions, and warnings can be carried with the blister packs (or other types of holders) which contain the medicament to which the information relates. In some embodiments, covering 12 comprises paperboard manufactured to have a smooth finish such that it is easily written on, allowing a blister card package user to record information such as when medication was administered or side effects felt after taking the medication. In an alternative embodiment, one sheet of paperboard may be folded to create a front card, rear card and extended side.

Various techniques can be employed to join the components of the blister package, such as covering 12 and surface 14, and hence to seal the blisters. Such methods include adhesive bonding, radio frequency welding, ultrasonic welding and hot bar sealing. Various adhesives can be employed to bond covering 12 and surface 14 within the scope of the disclosure. Such adhesives include, but are not limited to, cyanoacrylates, acrylics and polyurethanes. Covering 12 may comprise a heat seal coated aluminum foil. The coating on the foil can be compatible with the blister material to ensure satisfactory sealing both for product protection, e.g. to prevent the ingress of moisture and microorganisms, and for tamper resistance. In some embodiments, covering 12 can also have a degree of puncture resistance and sufficient tensile strength to prevent medicament 40 from being pushed through covering 12. Thus, in some embodiments, a cover sheet material such as polyester or paper may be used as a component of a foil lamination.

The perforations defining the separable units 20 and tab 28 comprise one or more of slits or creases aligned, in some embodiments, in a straight configuration. Suitably, the perforations are formed by kiss-cutting or laser-cutting. The relative thinness of each of the perforations can be determined by the amount of flex and/or tensile strength that is desired for either the perforations, and can be configured to have a thinness relative to adjacent connected structures such that a user can manipulate or tear the adjacent connected structures, such as, for example separable units 20 and/or tab 28, with respect to each other. The perforations are also configured to be thick enough to prevent destruction or tearing of the perforations during use and/or such that the perforations can guide the adjacent structures relative to each other during relative movement of the adjacent connected structures.

Perforation and/or creases or notches can be applied to the surface (e.g., film forming area), and/or covering (e.g., lidding) by for example, rotary pinned or needles using cold or heated pins or needle punches. Perforation and/or creases or notches can be applied to the surface (e.g., film forming area), and/or covering (e.g., lidding) by, for example, die punch sets or by laser etching or cutting to place the perforations and/or creases at the desired location (e.g., diagonal to the edges and the crease transverse to the perforation).

It will be apparent to those skilled in the art that various modifications and variations can be made to various embodiments described herein without departing from the spirit or scope of the teachings herein. Thus, it is intended that various embodiments cover other modifications and variations of various embodiments within the scope of the present teachings.

What is claimed is:

1. A container for storage of a medicament, the container comprising a surface having a cavity configured to store at least one dose of the medicament; and a covering disposed over at least the cavity of the surface and the covering comprising at least two adjacent edges, and consists of a first set of perforations, a second set of perforations and a third set of perforations and a crease, the first set of perforations extending along the first edge of the at least two adjacent edges, the second set of perforations extending along the second edge of the at least two adjacent edges, and the third set of perforations disposed on the covering and spaced apart from the at least two adjacent edges of the covering, the third set of perforations extending substantially diagonal to the first and the second edge, wherein the crease is disposed substantially perpendicular to the third set of perforations, the crease extending toward the cavity without contacting the cavity.

2. A container according to claim 1, wherein the surface further comprises at least two adjacent edges corresponding to the at least two adjacent edges of the covering and a set of perforations disposed on the surface corresponding to the third set of perforations of the covering and spaced apart from the at least two adjacent edges of the surface, the set of perforations extending substantially diagonally to the at least two adjacent edges of the surface.

3. A container according to claim 2, wherein the third set of perforations disposed on the covering and the set of perforations disposed on the surface are aligned and substantially parallel to each other.

4. A container according to claim 2, wherein the container comprises a blister package.

5. A container according to claim 4, wherein the crease contacts the third set of perforations.

6. A container according to claim 1, wherein the container is configured to be torn to dispense the medicament or gain access to the medicament.

7. A container according to claim 1, wherein the medicament is a single unit dose of a solid or liquid medicament.

8. A container according to claim 1, wherein the container comprises (i) at least two cavities, each cavity containing a single medicament or (ii) only one cavity with a single medicament disposed therein being in tablet, mini-tablet or capsule form.

9. A container according to claim 1, wherein the container is child-resistant.

10. A container according to claim 1, wherein the cavity is centered on the surface and comprises a circular shape.

11. A container according to claim 1, wherein the at least two adjacent edges define an outer perimeter of the container.

12. A container according to claim 1, wherein the third set of perforations is oriented at equivalent angles from each of the at least two adjacent edges.

13. A container according to claim 12, wherein the angles are 45°.

14. A container according to claim 1, wherein the first, the second and the third set of perforations defines a tab configured to be separated from the container.

15. A container according to claim 1, wherein the surface comprises a plurality of cavities to store a plurality of medicaments, one dose of each medicament in each cavity; and the covering disposed over at least the plurality of cavities, the third set of perforations of the covering extending substantially diagonal to the first set and the second set of perforations such that the first set of perforations, the second set of perforations, and the third set of perforations form a triangular area.

16. A container for storage of a medicament, the container comprising a surface having a cavity and a covering disposed over at least the cavity of the surface and, the covering comprising at least two adjacent edges, and consists of a first set of perforations, a second set of perforations and a third set of perforations and a crease, the first set of perforations extending along the first edge of the at least two adjacent edges, the second set of perforations extending along the second edge of the at least two adjacent edges, the third set of perforations disposed on the covering and spaced apart diagonally from the at least two adjacent edges of the covering, wherein the crease is disposed substantially perpendicular to the third set of perforations, the crease extending toward the cavity without contacting the cavity; the surface further having at least two adjacent edges, a first set of perforations of the surface extending along a first edge of the at least two adjacent edges of the surface, a second set of perforations of the surface extending along a second edge of the at least two adjacent edges of the surface and the cavity configured to store at least one dose of the medicament, wherein the third set of perforations is disposed on the surface and spaced apart from the at least two adjacent edges of the surface, the third set of perforations of the surface extending substantially diagonally to the at least two adjacent edges of the surface.

17. A container according to claim 16, wherein the first set of perforations of the covering corresponds to the first set of perforation of the surface, the second set of perforations of the covering corresponds to the second set of perforation of the surface, the third set of perforations corresponds to the third set of perforation of the surface.

18. A container according to claim 16, wherein the first set of perforations of the covering is substantially aligned and parallel vertically to the first set of perforation of the surface, the second set of perforations of the covering is substantially aligned and parallel vertically to the second set of perforation of the surface, the third set of perforations is substantially aligned and parallel vertically to the third set of perforation of the surface.

19. A container for storage of a medicament, the container comprising a sheet comprising a surface and a covering, the sheet comprising a plurality of separable units, each unit comprising a cavity configured to store at least one medicament and the covering disposed over at least the cavity of the surface and comprising at least two adjacent edges, and consists of a first set of perforations, a second set of perforations and a third set of perforations and a crease, the first set of perforations of the covering extending along the first edge of the at least two adjacent edges of the covering, the second set of perforations of the covering extending along the second edge of the at least two adjacent edges of the covering and the third set of perforations disposed on the covering and spaced apart diagonally from the at least two adjacent edges of the covering, the first set of perforations, the second set of perforations, and the third set of perforations form a triangular shaped tab, wherein the crease is disposed substantially perpendicular to the third set of perforations, the crease extending toward the cavity without contacting the cavity.

20. A method for dispensing a medicament from a container for storage of a medicament, the method comprising manipulating a tab of the container, the container comprising a surface having at least a cavity configured to store at least one dose of the medicament; and a covering disposed over at least the cavity of the surface and comprising at least two adjacent edges, and consists of a first set of perforations, a second set of perforations and a third set of perforations and a crease, the first set of perforations of the covering extending along the first edge of the at least two adjacent edges of the covering, the second set of perforations of the covering extending along the second edge of the at least two adjacent edges of the covering and the third set of perforations disposed on the covering and spaced apart diagonally from the at least two adjacent edges of the covering to form a triangular area defining the tab; separating the tab from the container; and tearing the container along a tear line defined by the crease disposed substantially perpendicular to the third set of perforations, and the crease extends toward the cavity without contacting the cavity.

21. A method for making a container for storage of a medicament, the method comprising placing a medicament in a cavity of a surface configured to store the medicament; sealing a covering over at least the cavity of the surface, the covering having at least two adjacent edges, and consists of a first set of perforations, a second set of perforations and a third set of perforations and a crease, the first set of perforations of the covering extending along a first edge of the at least two adjacent edges of the covering, the second set of perforations of the covering extending along a second edge of the at least two adjacent edges of the covering; and pressing the third set of perforations into the surface and/or covering such that the third set of perforations of the covering are spaced apart diagonally from the at least two adjacent edges to form a triangular area, wherein the crease is disposed substantially perpendicular to the third set of perforations, the crease extending toward the cavity without contacting the cavity.

22. A method according to claim 21, wherein the medicament is a solid dosage form.

23. A method according to claim 22, wherein the medicament is a tablet or capsule and one tablet or capsule is placed in the cavity.

24. A method according to claim 21, wherein the medicament is in a liquid dosage form and a single liquid dose is placed in the cavity.

* * * * *